US005318277A

United States Patent [19]

Brown et al.

[11] Patent Number: 5,318,277

[45] Date of Patent: Jun. 7, 1994

[54] LINED LADLES, LININGS THEREFOR, AND METHOD OF FORMING THE SAME

[75] Inventors: William K. Brown, Bridgeville, Pa.; Russell E. Gavran, Maplegrove, Ill.; Thomas W. Lewis, Bethel Park, Pa.

[73] Assignee: Dresser Industries, Inc., Dallas, Tex.

[21] Appl. No.: 921,420

[22] Filed: Jul. 28, 1992

Related U.S. Application Data

[63] Continuation of Ser. No. 622,367, Dec. 5, 1990, abandoned, which is a continuation of Ser. No. 377,592, Jul. 10, 1989, abandoned.

[51] Int. Cl.[5] ..... B22D 41/02

[52] U.S. Cl. ..... 266/275; 266/280; 266/286; 501/108

[58] Field of Search ..... 266/281, 275, 280, 286; 501/108, 119; 106/121

[56] References Cited

U.S. PATENT DOCUMENTS 4,042,229 8/1977 Eccleston ..... 266/275
4,043,543 8/1977 Courtenay et al. ..... 266/275
4,760,039 7/1988 Hlawatschek ..... 106/121
4,839,317 6/1989 Uchida et al. ..... 106/121

FOREIGN PATENT DOCUMENTS 1119622 3/1982 Canada .
0117778 7/1982 Japan .
0011272 1/1985 Japan .
1281771 7/1972 United Kingdom .

OTHER PUBLICATIONS

BNZ advertisement, *Dense Castables and Gunning Mixes*, BNZ Materials Inc., Sep. 1988.
Premier ad, *Basilite Gun Coatings*, Dec. 1985, Premier Refractories and Chemicals, Inc.
Dossolite, *Dossolite Tundish Spray System*, Dec. 1985, Harbison-Walker Refractories, Dresser Industries, Inc.

*Primary Examiner*—Scott Kastler

[57] ABSTRACT

A ladle having a hydrocarbon-free, expendable refractory insulating lining that is chemically compatible with the molten metal to be placed in the ladle.

2 Claims, 1 Drawing Sheet

LINED LADLES, LININGS THEREFOR, AND METHOD OF FORMING THE SAME

This application is a continuation, of application Ser. No. 622,367 filed Dec. 5, 1990, now abandoned which in turn is a continuation of application Ser. No. 377,592 filed Jul. 10, 1989, now abandoned.

BACKGROUND OF THE INVENTION

In foundry ladles, which are used to transfer iron and steel from the melting furnace to the mold(s), heat loss from the molten metal through the ladle lining is a major problem. This is especially true in ladles that have a small "volume to surface area" ratio. Increasing the lining thickness and adding more insulation at the ladle shell is generally not practical because of their already small diameter. Another problem is the removal of solidified slag and metal which adheres strongly to the ladle lining after each mold-pouring operation. These remnant materials must be thoroughly removed to prevent contamination of the next batch of liquid metal. One method of lining foundry ladles is to use tundish boards, but these boards have clear disadvantages such as prolonged installation time, joints between the boards, and difficulty forming a thicker slagline zone. U.S. Pat. No. 4,330,107 describes in detail the use of tundish boards as lining materials in foundry ladles. A need exists to eliminate the current problems associated with lining ladles.

Efforts to utilize refractory linings which can be applied by spraying, trowelling, gunning, and the like have not been successful since they have contained materials which act to contaminate the iron and steel, such as resinous binders and oxidizers such as $Fe_2O_3$. Such a lining for tundishes is shown in Canadian Patent No. 1,119,622.

SUMMARY OF THE INVENTION

The problems of the prior art are overcome in an inexpensive and rapid manner by the instant invention.

This invention involves the application of hydrocarbon-free, expendable refractory insulating lining to a foundry ladle with the aim of significantly reducing heat loss from the metal, such as iron or steel, improving deskulling of the used ladle, and providing a chemically compatible lining with the iron or steel.

DETAILED DESCRIPTION

Figure 1:
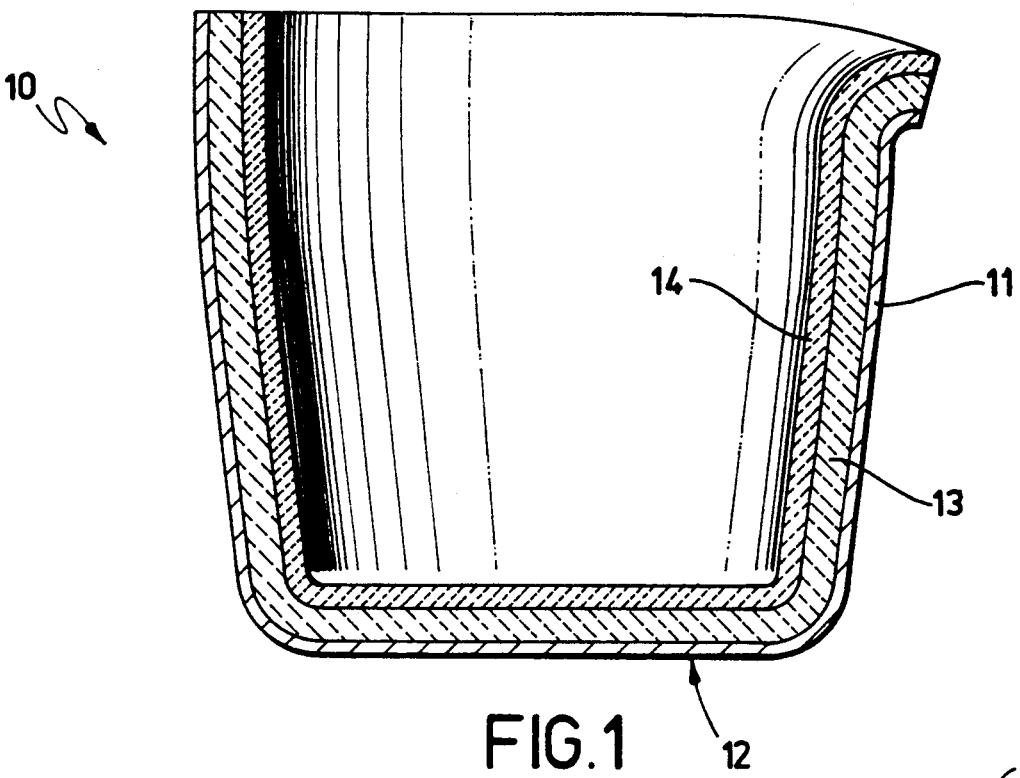
FIG. 1 is an elevational sectional view of a ladle in accordance with the present invention.

Referring to FIG. 1 there is shown top-pouring ladle 10 having a metal wall 11 and bottom 12. Permanent refractory lining 13 conventionally made of brick is suitably attached to metal ladle 10. Such structure as has just been described is conventional. The novelty in the instant invention is providing a unitary integrally formed expendable refractory lining 14 over the permanent lining 13.

The expendable lining 14 is preferably hydrocarbon-free magnesite-based sprayable composition containing at least about 60% (and preferably 75%) by weight magnesia and low thermal conductivity (K) of less than about 5 and preferably about 4.2 BTU in/° F. ft$^2$. hr. at 1600° F. mean temperature. Such compositions are known and contain other insulating oxides such as silica and alumina and minor amounts of oxides such as lime and iron oxide. Such compositions contain the usual minor amounts of materials which have no effect such as accessory oxides. Particularly preferred is a magnesite-based spray mix sold under the name DOSSOLITE 1400-72 whose physical properties and chemical analysis is set forth in Table I below.

Another advantage of using a magnesite spray mix is the absence of hydrogen pick-up by the steel. Hydrogen is known to be an undesirable contaminant in steel. This is a disadvantage of using tundish boards, which are bonded with a hydrocarbon that liberates hydrogen when in contact with molten steel and a disadvantage in using refractory trowelling or vibratable mixes that contain hydrocarbons, such as resin binders, that liberate hydrogen.

Although the magnesite-based spray mix is preferred for the previously mentioned metallurgical advantages, some grades of steel and practices will tolerate the use of silica/fireclay-based or high alumina-based spray mixes which have insulating properties, but which do not contain hydrocarbons. Therefore, within the spirit of this invention it must be recognized that other refractory oxides or combinations thereof could be substituted in part or wholly for the magnesite-based spray mix.

Figure 2:
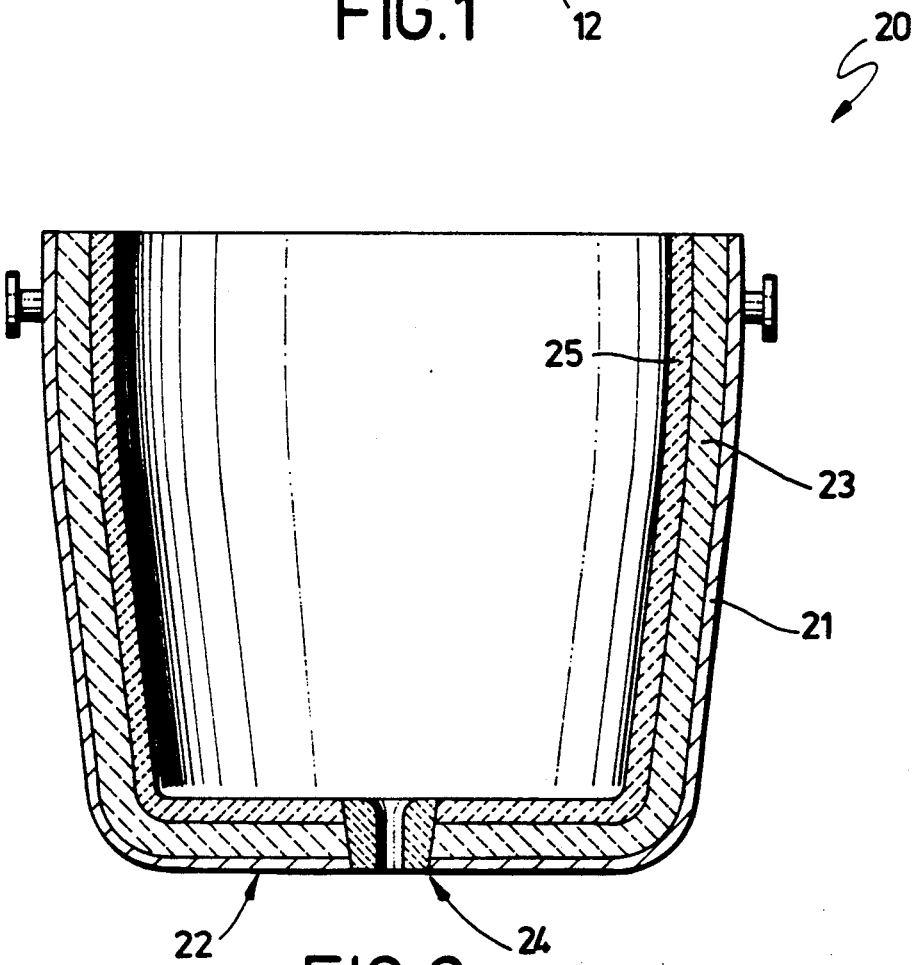
FIG. 2 is an elevational view of an alternate embodiment of a ladle in accordance with the present invention.

FIG. 2 shows an alternate embodiment in which a bottom pouring ladle 20 is shown, again having a metal wall 21 and bottom 22, permanent refractory lining 23, and a spout 24. This structure is conventional. In the instant invention a unitary expendable lining 25 is provided over permanent lining 24. Here again, such expendable lining must be of the hydrogen-free type discussed above. It will be evident that any type of ladle; i.e, top-pour, bottom-pour, and the like, can be utilized.

The lining is provided by spraying the mix onto the permanent lining of the ladles to the thickness desired. The sprayable mix is formed to the desired consistency by simply admixing the dry mix with water. The particular ratio of dry mix and water will vary dependent upon the particulars of each dry mix, but can be readily determined by routine experimentation. While spraying is preferred, the mix can be admixed with the requisite amount of water and can be applied by trowelling or hand-daubing.

The expendable lining can be applied to any thickness desired to give the degree of insulation desired, usually about ½" to 1½" being most practical.

After being applied, the expendable lining is dried by heating to about 1000° F. to remove the water and then may be preheated to about 2000° F. (optional). The ladle is now ready for use. After use, the lining can be readily removed by simply inverting the ladle and dumping out the lining. The ladle can then be readily relined with a new expendable lining as described above.

The invention will be further described in connection with the following example which is for purposes of illustration only.

EXAMPLE

A 5NT capacity foundry ladle was lined with DOSSOLITE 1400-72 mixed with water to a putty-like consistency by hand-daubing to a thickness of about 1" to 1½" over the permanent lining on the wall and bottom.

This lining was heated to 1000° F. to dry the lining, and then steel at a temperature of 3000° F. was tapped into the ladle and then poured from the ladle into molds.

The steel suffered a temperature loss of only about 30° F. during this time as compared to losses of 100° to 200° F. which are typical with linings without a Dossolite coating.

After cooling, the ladle was easily deskulled by removing the expendable lining. The ladle was then ready for a new expendable lining to be applied.

TABLE I

| Properties of Dossolite 1400-72 | | |
|---|---|---|
| Physical Properties: | | |
| Bulk Density, After Drying | | 100 pcf |
| Thermal Conductivity, BTU/HR | | |
| $Ft^2$ °F./In. @ | 250° F. | 3.1 |
| | 650 | 3.1 |
| | 1000 | 3.4 |
| | 1300 | 3.9 |
| | 1600 | 4.2 |
| Chemical Analysis: | | % by Wt. |
| Silica ($SiO_2$) | | 16 |
| Alumina ($Al_2O_3$) | | 1.5 |
| Iron Oxide ($Fe_2O_3$) | | 3.0 |
| Line (CaO) | | 1.0 |
| Magnesia (MgO) | | 75.0 |
| Accessory oxides | | 1.5 |
| Loss of Ignition, % | | 2.0 |

The present invention has the advantages of decreased installation time (about one-fourth that required to line a ladle with tundish boards), formation of a joint-free lining, slagline zoning to any thickness, and lower energy costs due to decreased heat loss from the ladle.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A ladle consisting essentially of a rigid metallic outer casing, at least one layer of permanent refractory material adjacent said casing, and a unitary, integrally-formed expendable inner lining of refractory material, said expendable lining made of a mix consisting of:

| | % by Wt. |
|---|---|
| Silica ($SiO_2$) | 16 |
| Alumina ($Al_2O_3$) | 1.5 |
| Iron Oxide ($Fe_2O_3$) | 3 |
| Lime (CaO) | 1 |
| Magnesia (MgO) | 75 |
| Accessory Oxides | 1.5 |
| Loss on Ignition | 2 |

having a thermal conductivity of less than about 4.2 BTU in/° $F.^2$ hr. at 1600° F. mean temperature and being chemically compatible with the molten metal to be placed in the ladle.

2. A unitary, integrally-formed expendable lining of refractory material for the interior of a ladle said refractory material consisting of:

| | % by Wt. |
|---|---|
| Silica ($SiO_2$) | 16 |
| Alumina ($Al_2O_3$) | 1.5 |
| Iron Oxide ($Fe_2O_3$) | 3 |
| Lime (CaO) | 1 |
| Magnesia (MgO) | 75 |
| Accessory Oxides | 1.5 |
| Loss of Ignition | 2 |

and having a thermal conductivity of less than about 4.2 BTU in/° F. $ft.^2$ hr. at 1600° F. mean temperature and being chemically compatible with the molten metal to be placed in the ladle.

* * * * *